US008182167B2

(12) United States Patent
Liu

(10) Patent No.: US 8,182,167 B2
(45) Date of Patent: May 22, 2012

(54) RETRACTABLE LAMP PEN

(75) Inventor: Liang Liu, Ningbo (CN)

(73) Assignee: Beifa Group Co., Ltd., Ningbo (CN)

( * ) Notice: Subject to any disclaimer, the term of this patent is extended or adjusted under 35 U.S.C. 154(b) by 400 days.

(21) Appl. No.: 12/582,648

(22) Filed: Oct. 20, 2009

(65) Prior Publication Data

US 2010/0098478 A1 Apr. 22, 2010

(30) Foreign Application Priority Data

Oct. 22, 2008 (CN) ..... 2008 1 0121906

(51) Int. Cl.
*B43K 5/16* (2006.01)
*B43K 29/00* (2006.01)

(52) U.S. Cl. ..... 401/195; 401/110; 401/112

(58) Field of Classification Search ..... 401/52, 401/195, 109, 110, 111, 112, 113, 116
See application file for complete search history.

(56) References Cited

U.S. PATENT DOCUMENTS 2,905,147 A 9/1959 Johmann
3,051,132 A 8/1962 Johmann
3,137,276 A 6/1964 Weisser
3,288,115 A 11/1966 Hechtle
5,131,775 A 7/1992 Chen
5,544,967 A * 8/1996 Yao ..... 401/195
5,570,967 A 11/1996 Chen
6,439,734 B1 * 8/2002 Lo ..... 362/118
6,719,473 B1 * 4/2004 Kao ..... 401/195
7,086,797 B1 * 8/2006 Huang ..... 401/195

* cited by examiner

*Primary Examiner* — David J. Walczak

(74) *Attorney, Agent, or Firm* — Christensen O'Connor Johnson & Kindness PLLC

(57) ABSTRACT

A lamp pen includes a pen body, a refill, a conductive rotating slide, a lamp, and a cartridge holding a battery. The rotating slide is electrically connected to the battery. A conductive bar on a surface of the slide abuts an end of the cartridge, which comprises a helical surface forming higher and auxiliary higher slots disposed at a highest point of the surface. A first lead of the lamp is connected to the battery, and a second lead is affixed within the higher slot. Rotating the slide causes the conductive bar to engage either the higher slot or auxiliary higher slot, pushing the cartridge downward so that the refill extends out of the pen tip. When the higher slot is engaged, the second lead of the lamp connects to the conductive bar, the electric circuit completes, and the lamp illuminates.

20 Claims, 4 Drawing Sheets

RETRACTABLE LAMP PEN

BACKGROUND

Currently, there are many writing instruments, for example, retractable ball-point pens, known in the art that have built-in lamps, such as LED lamps, thus making the pen usable in a dark environment. Usually, retractable pens with built-in lamps work as follows: when a pen's writing end is extended out of the pen, the built-in lamp turns on, and when the pen's writing end is retracted, the lamp turns off. However, pens of the above kind have a serious shortcoming: the lamp always turns on when the pen's writing end is out, which reduces a lamp battery life as the lamp stays turned on even in a bright environment when the lamp is not needed for writing.

There are retractable lamp pens known in the art that have separate switches for turning a built-in pen lamp on and off. However, the above solution also has a shortcoming in that it requires providing additional hardware associated with a lamp switch, which results in increased cost, assembly problems, and diminished reliability compared to a conventional retractable pen. Furthermore, a user has to use two separate switches in one pen, one for extending a pen's writing end out of the pen's body, and another for illuminating the lamp. Therefore, there is a need to provide a retractable pen having a built-in lamp that would switch on only when necessary, for example, in a dark environment, and that could be turned off in a light environment, wherein extending and retracting the writing end of the pen and turning on and off the built-in lamp can be operated by a single switch.

SUMMARY

The following summary is provided to introduce a selection of concepts in a simplified form that are further described below in the Detailed Description. This summary is not intended to identify key features of the claimed subject matter, nor is it intended to be used as an aid in determining the scope of the claimed subject matter.

An embodiment of a retractable lamp pen is disclosed. In one embodiment, the lamp pen includes a tubular pen body having at least a partially transparent lower portion, an upper portion, and a guiding slot axially disposed inside the upper portion. The pen further includes a pen tip removably attachable to the lower portion of the pen body and partially enclosing the lower portion of the pen body, a refill disposed in the lower portion of the pen body, a cap partially enclosing an upper part of the pen body, a conductive rotating slide, a lamp that is disposed toward the lower end of the pen body, and a battery cartridge.

The conductive rotating slide has an outer surface and is fixedly disposed in the cap. The conductive rotating slide further comprises a conductive connector fixedly disposed in the rotating slide, and a conductive bar axially disposed on the outer surface of the rotating slide.

The battery cartridge is disposed in the upper portion of the pen body, and has an upper end and a lower end. The upper end of the battery cartridge comprises a helical end surface with a higher locating slot disposed at a highest point of the helical end surface, an auxiliary higher slot disposed adjacent to the higher locating slot, a stop protruding axially between the higher locating slot and the auxiliary higher locating slot, and a lower locating slot disposed at a lowest point of the helical end surface.

The battery cartridge further comprises a guiding bar disposed axially on an outer surface of the battery cartridge and having a slot aligned with the mounting slot and extending through the guiding bar to the higher locating slot of the helical end surface.

The battery cartridge is adapted to hold a battery such that the conductive connector of the rotating slide is electrically connected to the battery.

The lamp has a first lead and a second lead, the first lead being electrically connected to the battery and the second lead being disposed in the mounting slot of the battery cartridge such that the second lead is fixedly connected through the guiding bar to the higher locating slot.

In a first position of the rotating slide, the conductive bar engages the lower locating slot and the refill is retracted from within the pen tip. Rotating the rotating slide from the first position in a first direction causes the conductive bar to slide on the helical end surface until the conductive bar engages the higher locating slot and the guiding bar engages the guiding slot, thereby pushing the battery cartridge downward in the pen body so that the refill extends out of the pen tip. The second lead of the lamp electrically connects to the conductive bar such that the lamp is illuminated.

Rotating the rotating slide from the first position in a second direction causes the conductive bar to slide on the helical end surface until the conductive bar engages the auxiliary higher locating slot and the guiding bar engages the guiding slot, thereby pushing the battery cartridge downward in the pen body so that the refill extends out of the pen tip and the second lead of the lamp is not electrically connected to the conductive bar.

Returning the rotating slide to the first position causes the conductive bar to slide on a helical end surface until the conductive bar engages the lower locating slot. A reset spring inserted between the lower end of the battery cartridge and the pen tip pushes the battery cartridge upward in the pen body so that the refill is withdrawn inside the pen body.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
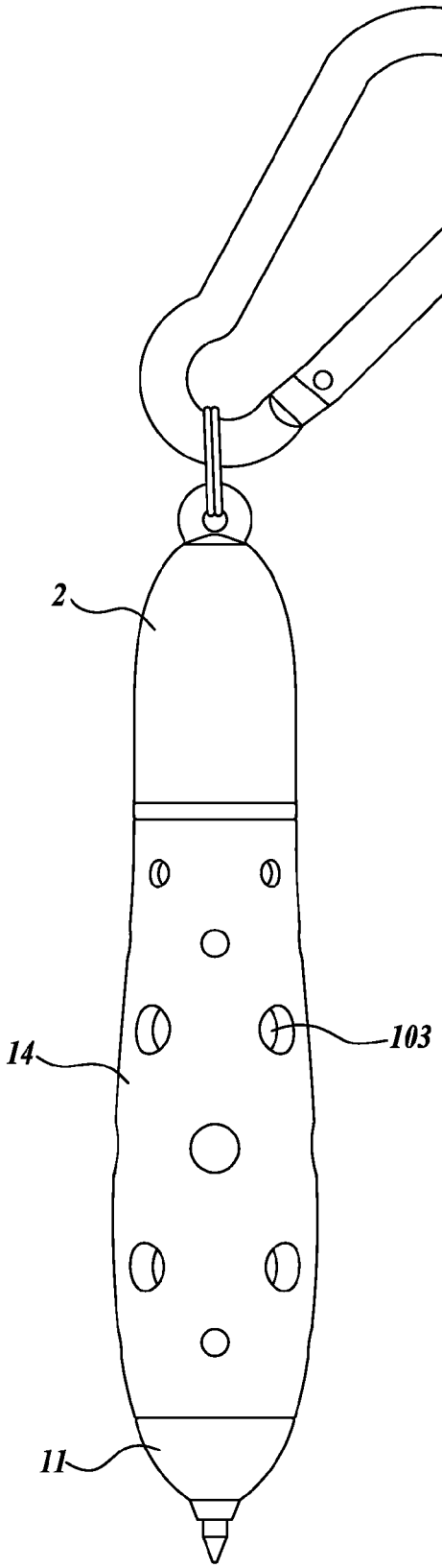
FIG. 1 is a front elevation view of a retractable lamp pen constructed in accordance with an embodiment of the present invention.
Figure 2:
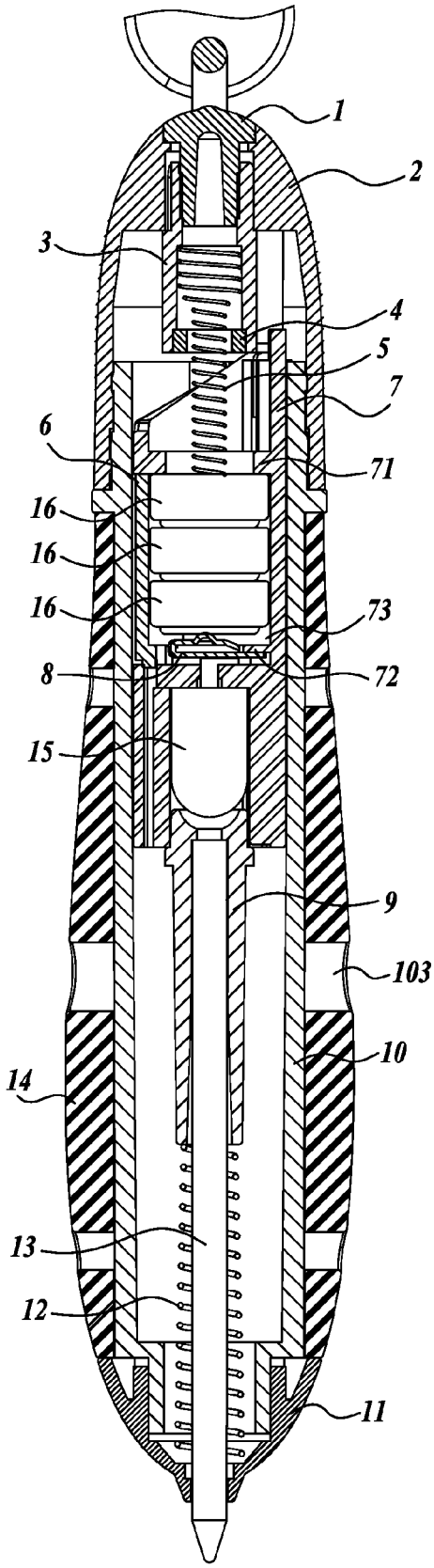
FIG. 2 is an enlarged section view of the lamp pen shown in FIG. 1.

FIGS. 1-6 illustrate an embodiment of a retractable lamp pen. As illustrated in FIGS. 1 and 2, the lamp pen comprises a pen body 10, a pen tip 11, a cap 2, a rotating slide 3 fixedly disposed in the cap 2, and a conductive spring 5 disposed in the rotating slide 3. The cap 2 encloses an upper part of the pen body 10. The pen tip 11 is removably (in one embodiment, threadably) connected to a lower part of the pen body 10.

The pen body 10 may be enclosed by a sheath 14. In one embodiment, the sheath 14 has a plurality of through apertures 103 that serve to let through light emanating from a built-in pen lamp. The operation of the lamp is described below in greater detail. One skilled in the art will appreciate that the sheath 14 may be constructed in a number of ways that would allow for a light produced by a built-in lamp to illuminate a writing surface or otherwise allow the lamp pen to serve as a flashlight. Therefore, the above-described solution is by no means limiting, but simply illustrative. The cap 2 effectively comprises an upper portion, and the sheath 14 effectively comprises a lower portion of the lamp pen.

As illustrated in FIG. 2, refill 13 is disposed inside the pen body 10. In one embodiment, an upper end of the refill 13 is enclosed by a tail plug 9, and a reset spring 12 is inserted between the tail plug 9 and the pen tip 11. The reset spring 12 may be disposed around the refill 13.

Figure 4:
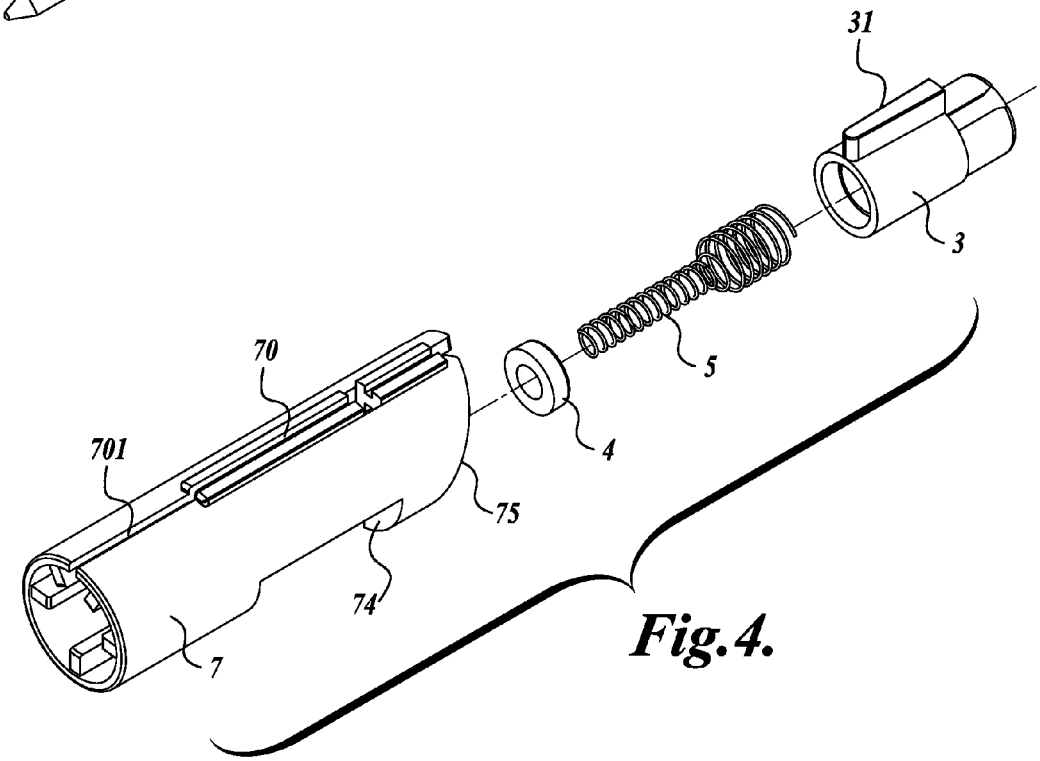
FIG. 4 is an exploded perspective view of a battery cartridge and a rotating slide forming part of the internal structure shown in FIG. 3.

A battery cartridge 7 is disposed inside the pen body 10. An end of the tail plug 9 is inserted into a lower end of the battery cartridge 7. In one embodiment, an upper plate 71 and a lower plate 72 are integrally disposed in the battery cartridge 7. An inner cavity 73 for accommodating one or more batteries 16 is formed between the upper plate 71 and the lower plate 72. In one embodiment, as best seen in FIG. 4, a battery port 74 is disposed on the battery cartridge 7 opposite the inner cavity 73. A battery cover 6 may be used to cover the battery port 74.

A lamp 15, in one embodiment an LED lamp, is disposed inside the battery cartridge 7. In one embodiment, a lamp pin inserting sheet 8 is also disposed inside the battery cartridge 7 so that a cathode of the lamp 15 is connected to a cathode of the battery 16 through the lamp pin inserting sheet 8.

As shown in FIG. 2, the cap 2 may be connected with a cap stopper 1, while an upper end of the rotating slide 3 abuts the cap 2. In one embodiment, the cap stopper 1 and the rotating slide 3 are threadably connected.

Figure 3:
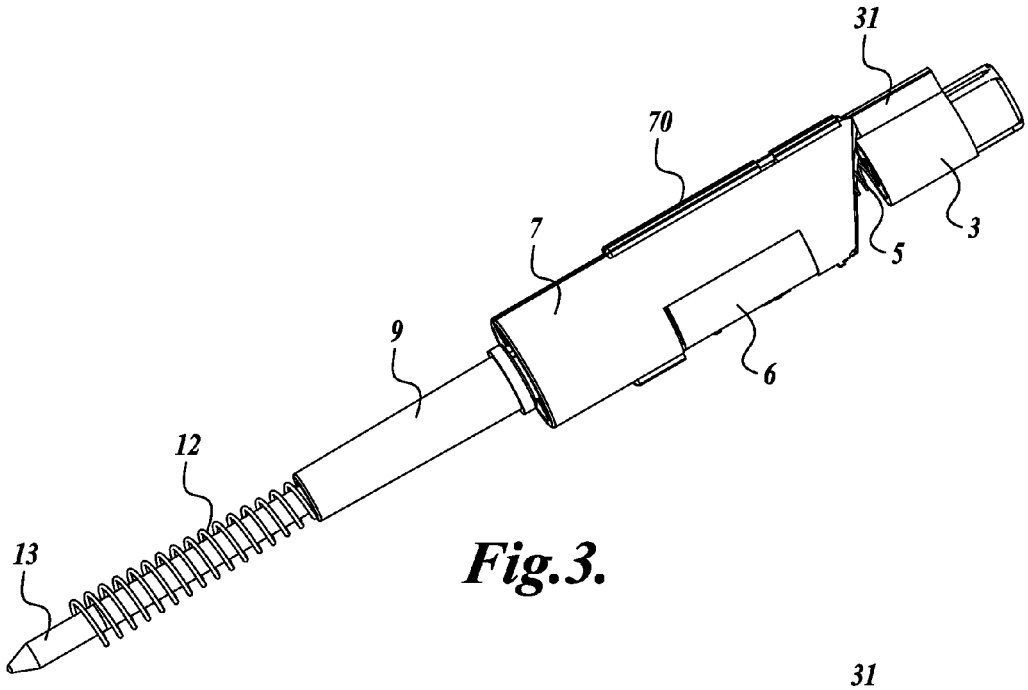
FIG. 3 is a perspective view of internal structure of the lamp pen shown in FIGS. 1 and 2.

In one embodiment, a diameter of an upper end of the conductive spring 5 is larger than a diameter of a lower end thereof. Referring now to FIGS. 2 to 4, the upper end of the conductive spring 5 is disposed inside the rotating slide 3. A fixing ring 4 is fixedly disposed at the lower end of the rotating slide 3. The lower end of the conductive spring 5 passes through the fixing ring 4 and contacts an anode of the battery 16. A conductive bar 31 is integrally disposed on an outer circumferential surface of the rotating slide 3.

Figure 5:
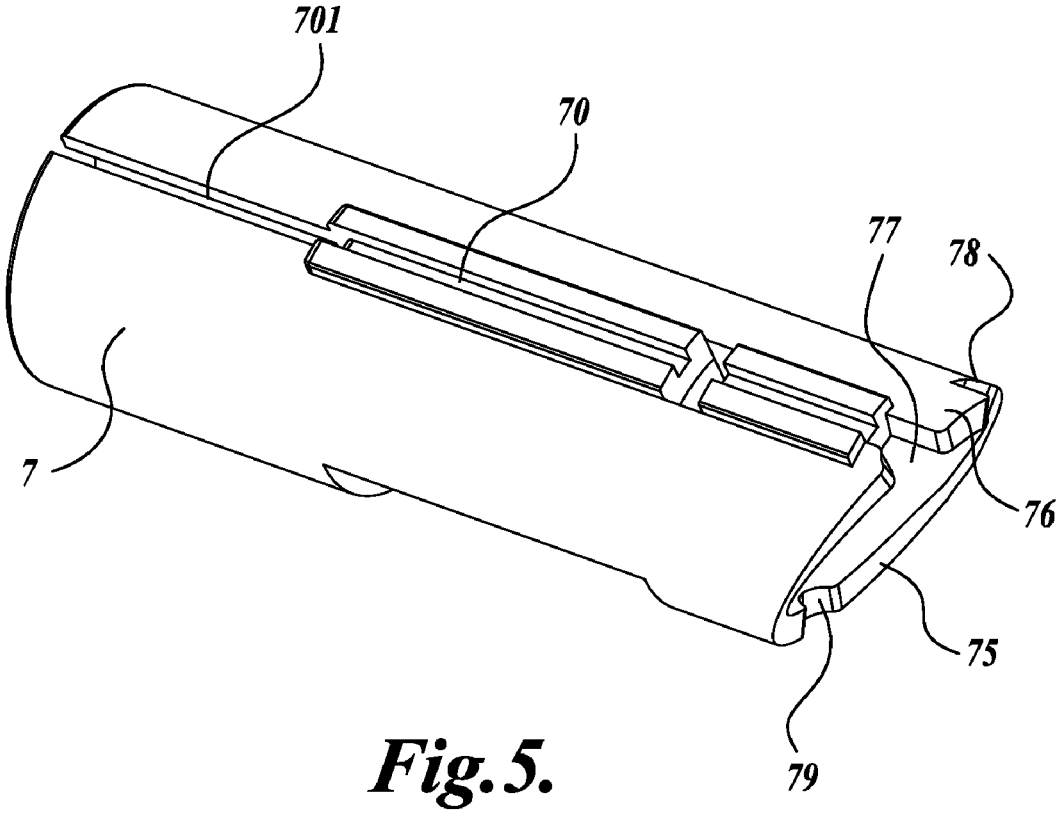
FIG. 5 is another perspective view of the battery cartridge shown in FIG. 4.

With reference to FIG. 5, an upper end surface of the battery cartridge 7 comprises a helical end surface 75. The helical end surface 75 is cut in the body of the battery cartridge at an angle that is less than 90 degrees such that it has a highest point and a lowest point relative to the bottom end of the battery cartridge, as best seen in FIG. 5. A stop, in one embodiment in the form of a post 76, protrudes axially from the highest point of the helical end surface 75.

The battery cartridge 7 includes both higher and lower locating slots. A higher locating slot 77 is disposed on one side of the post 76, and an auxiliary higher locating slot 78 is disposed on the other side of the post 76 on the helical end surface 75. A lower locating slot 79 is disposed at the lowest point of the helical end surface 75. In operation, as described below in greater detail, the higher locating slot 77, the auxiliary higher locating slot 78, or the lower locating slot 79 alternately engages with the conductive bar 31 of the rotating slide 3 as the rotating slide is rotated.

Figure 6:
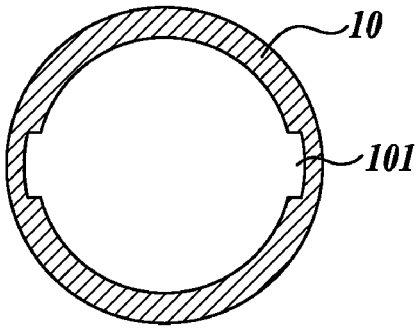
FIG. 6 is a radial section view of a pen body of the lamp pen shown in FIGS. 1 and 2.

As best seen in FIGS. 3-5, a guiding bar 70 is disposed along an outer surface of the battery cartridge 7, ending with the higher locating slot 77, and a mounting slot 701 extends axially from the guiding bar 70 away from the higher locating slot 77. In one embodiment, the mounting slot 701 matches a slot of the guiding bar 70 so that a connector can easily pass through the elements 701 and 70. An anode of the lamp 15 passes through the mounting slot 701 and fixedly connects to the higher locating slot 77. One skilled in the art will appreciate that there are a number of ways to fixedly connect the anode of the lamp 15 to the higher locating slot 77, for example, with an adhesive. Furthermore, as shown in FIG. 6, a guiding slot 101 is disposed coaxially inside the pen body 10 such that the guiding bar 70 and the guiding slot 101 are engageable with each other when the battery cartridge slides down the pen body 10.

In the above embodiment, the rotating slide 3 is made of plastic, and the surface of the rotating slide 3 is covered with a conductive layer in order to implement the conductive function of the rotating slide 3.

In one embodiment, the electric circuit of the lamp pen operates as follows. The conductive spring 5 fixed inside the conductive rotating slide 3 contacts the anode of the battery 16, and the cathode of the battery 16 contacts the cathode of the lamp 15. The conductive spring 5 is electrically connected with the conductive bar 31 through the conductive surface of the conductive rotating slide 3. The anode of the lamp 15 is fixedly connected to the higher locating slot 77. When the higher locating slot 77 engages with the conductive bar 31 on the rotating slide 3, the anode of the lamp 15 contacts the conductive bar 31 to form a closed electric circuit, thus turning on the lamp 15. Simultaneously, when the conductive bar 31 engages with the higher locating slot 77, the battery cartridge 7 is pushed downward in the pen body 10 so that the refill 13 extends out of the pen tip 11 and writing can be performed with the lamp 15 turned on. The lamp 15 is turned off by rotating the rotating slide 3 so that the conductive bar 31 disengages from the higher locating slot 77. Because the rotating slide 3 is fixedly disposed in the cap 2, rotating the pen body 10 relative to the cap 2 or rotating the cap 2 relative to the pen body 10 will rotate the rotating slide 3.

The post 76 is disposed at the highest point of the helical end surface 75, and the higher locating slot 77 and the auxiliary higher locating slot 78 are disposed at opposite sides of the post 76 so that the pen may be used in three different positions.

In the first position, when the rotating slide 3 is rotated toward the lower locating slot 79 on the helical end surface 75, the battery cartridge 7 is forced upward inside the pen body 10 by the rest spring 12 and the refill 13 retracts into the pen tip 11. The lamp 15 stays off in this position.

In the second position, when the rotative slide 3 is rotated in one direction and the conductive bar 31 engages with the higher locating slot 77, the refill 13 extends out of the pen tip 11, the lamp 15 turns on, and the pen is ready for use in a dark environment.

In the third position, when the rotative slide 3 is rotated in another direction and the conductive bar 31 engages with the auxiliary higher locating slot 78, the refill 13 extends out of the pen tip 11, but the lamp 15 stays off because the anode of the lamp 15, connected to the higher locating slot 77 but not the auxiliary higher locating slot 78, is not electrically connected to the conductive bar 31. Thus, the pen is ready for use in a light environment, while the energy of the battery 16 is saved.

The mounting slot 701 is disposed adjacent to, and matches, the slot in the guiding bar 70, and the anode of the lamp 15 is disposed inside the mounting slot 701 and the guiding bar 70, so that the anode of the lamp 15 is protected from being damaged during assembly. Furthermore, this construction affords a good electrical contact between the anode of the lamp 15 and the higher locating slot 77.

While illustrative embodiments have been illustrated and described, it will be appreciated that various changes can be made therein without departing from the spirit and scope of the invention.

The embodiments of the invention in which an exclusive property or privilege is claimed are defined as follows:

1. A retractable lamp pen, comprising:

a tubular pen body having a lower part that is at least partially transparent, an upper part, and a guiding slot axially disposed inside the upper part;

a pen tip attachable to the lower part of the pen body;

a refill disposed in the lower part of the pen body;

a cap at least partially enclosing the upper part of the pen body;

a conductive rotating slide disposed in the cap and having an outer surface, the conductive rotating slide further comprising:

a conductive connector disposed in the rotating slide, and a conductive bar axially disposed on the outer surface of the rotating slide;

a battery cartridge disposed in the upper part of the pen body and having an upper end and a lower end, the lower end having a mounting slot disposed axially along the lower end, and the upper end comprising:

a helical end surface configured with a higher locating slot disposed at a highest point of the helical end surface, an auxiliary higher slot disposed adjacent to the higher locating slot, a stop protruding axially between the higher locating slot and the auxiliary higher locating slot, and a lower locating slot disposed at a lowest point of the helical end surface, and a guiding bar disposed axially on an outer surface of the battery cartridge and having a slot aligned with the mounting slot and extending through the guiding bar to the higher locating slot of the helical end surface, wherein the battery cartridge is adapted to hold a battery such that the conductive connector of the conductive rotating slide is adapted to be electrically connected to the battery; and a lamp that is disposed toward the lower end of the pen body, the lamp having a first lead and a second lead, the first lead adapted to be electrically connected to the battery, and the second lead being disposed in the mounting slot of the battery cartridge such that the second lead is fixedly connected through the guiding bar to the higher locating slot, wherein, in a first position of the rotating slide, the conductive bar engages the lower locating slot and the refill is retracted from within the pen tip, wherein rotating the rotating slide from the first position in a first direction causes the conductive bar to slide on the helical end surface until the conductive bar engages the higher locating slot and the guiding bar engages the guiding slot, thereby pushing the battery cartridge downward in the pen body so that the refill extends out of the pen tip, wherein the second lead of the lamp electrically connects to the conductive bar causing the lamp to illuminate, and wherein rotating the rotating slide from the first position in a second direction causes the conductive bar to slide on the helical end surface until the conductive bar engages the auxiliary higher locating slot and the guiding bar engages the guiding slot, thereby pushing the battery cartridge downward in the pen body so that the refill extends out of the pen tip and the second lead of the lamp is not electrically connected to the conductive bar.

2. The retractable lamp pen of claim 1, further comprising a reset spring disposed around the refill between the lower end of the battery cartridge and the pen tip.

3. The retractable lamp pen of claim 2, wherein, when the rotating slide is moved to the first position, the conductive bar slides on the helical end surface until the conductive bar engages the lower locating slot and the reset spring pushes the battery cartridge upward in the pen body so that the refill is withdrawn inside the pen body.

4. The retractable lamp pen of claim 1, further comprising a lamp pin inserting sheet disposed in the battery cartridge such that the first lead of the lamp is adapted to be connected to the battery through the lamp pin inserting sheet.

5. The retractable lamp pen of claim 1, wherein the battery cartridge further comprises an inner cavity for accommodating the battery disposed in the battery cartridge, a battery port disposed at a position on the battery cartridge opposite the inner cavity, and a battery cover adapted to cover the battery port.

6. The retractable lamp pen of claim 1, wherein the rotating slide further comprises a fixing ring disposed at the lower end of the rotating slide.

7. The retractable lamp pen of claim 1, wherein the conductive connector comprises a conductive spring.

8. The retractable lamp pen of claim 7, wherein an upper end of the conductive spring is disposed inside the rotating slide and a lower end of the conductive spring is adapted to contact the battery.

9. The retractable lamp pen of claim 8, wherein a diameter of the upper end of the conductive spring is greater than a diameter of the lower end thereof.

10. The retractable lamp pen of claim 1, wherein the cap is connected with a cap stopper, the cap stopper and the rotating slide being in a removable connection.

11. The retractable lamp pen of claim 1, wherein the rotating slide is made of plastic and covered with a conductive layer.

12. The retractable lamp pen of claim 1, wherein a tail of the refill is enclosed by a tail plug that abuts a lower end surface of the battery cartridge, and the reset spring is inserted between the tail plug and the pen tip.

13. The retractable lamp pen of claim 1, wherein the pen body is enclosed by a sheath, the sheath having at least one aperture adapted to allow light produced by the lamp to emanate from the lamp pen.

14. The retractable lamp pen of claim 1, wherein the pen tip and the pen body are threadably connected to each other.

15. A retractable lamp pen, comprising:

a tubular pen body that is at least partially transparent;

a battery cartridge slidably disposed in an upper part of the pen body and having an upper end and a lower end with a refill affixed thereto, the upper end of the battery cartridge having a helical end surface forming a higher locating slot disposed at a highest point of the helical end surface, an auxiliary higher slot disposed adjacent to the higher locating slot, and a lower locating slot disposed at a lowest point of the helical end surface, wherein the cartridge is adapted to hold a battery;

a lamp disposed in the pen body, the lamp having a first lead and a second lead, the first lead adapted to be electrically connected to the battery;

a conductive rotating slide having a conductive bar disposed on an outer surface of the rotating slide and abutting the helical end surface of the battery cartridge, the conductive rotating slide adapted to be electrically connected to the battery; and an electrical connection adapted to connect the second lead of the lamp to the battery through the rotating slide when the conductive bar of the rotating slide engages the higher locating slot, wherein rotating the conductive rotating slide until the conductive bar engages the lower locating slot causes the refill to retract inside the pen body, wherein rotating the conductive rotating slide until the conductive bar engages the higher locating slot pushes the battery cartridge downward in the pen body so that the refill extends out of the pen body and the second lead of the lamp electrically connects to the conductive bar causing the lamp to illuminate, and wherein rotating the conductive rotating slide until the conductive bar engages the auxiliary higher locating slot pushes the battery cartridge downward in the pen body so that the refill extends out of the pen body while the second lead of the lamp is not electrically connected to the conductive bar.

16. The retractable lamp pen of claim 15, wherein the electrical connection for connecting the second lead of the lamp to the battery through the rotating slide comprise a conductive connector fixedly connected to the higher locating slot.

17. The retractable lamp pen of claim 16, wherein the conductive connector is disposed within a mounting slot in the battery cartridge.

18. The retractable lamp pen of claim 17, wherein the battery cartridge further comprises a guiding bar disposed axially on an outer surface of the battery cartridge and having a slot aligned with the mounting slot and extending through the guiding bar to the higher locating slot of the helical end surface.

19. The retractable lamp pen of claim 18, wherein the pen body includes a guiding slot axially disposed inside the pen body and adapted to engage the guiding bar of the battery cartridge.

20. The retractable lamp pen of claim 15, wherein the conductive rotating slide is adapted to be electrically connected to the battery by a conductive spring disposed in the conductive rotating slide and adapted to abut the battery.

* * * * *